United States Patent [19]

Adams

[11] 4,201,318

[45] May 6, 1980

[54] PACKING INJECTOR GUN

[76] Inventor: Harold R. Adams, St. Francisville, Ill. 62460

[21] Appl. No.: 911,380

[22] Filed: Jun. 1, 1978

[51] Int. Cl.[2] ..... B67D 5/42

[52] U.S. Cl. ..... 222/324; 222/389

[58] Field of Search ..... 222/389, 323, 324

[56] References Cited

U.S. PATENT DOCUMENTS

| | | | |
|---|---|---|---|
| 1,609,015 | 11/1926 | Engbrecht | 222/389 |
| 1,648,896 | 11/1927 | Gresser | 222/323 |
| 1,868,701 | 7/1932 | Goerland | 222/389 X |
| 2,312,544 | 3/1943 | Gould | 31/8 |
| 2,563,636 | 8/1951 | Ballard | 222/389 |
| 3,248,023 | 4/1966 | Dinenthal et al. | 222/389 |
| 3,254,806 | 6/1966 | Madsen | 222/389 X |

*Primary Examiner*—Allen N. Knowles
*Attorney, Agent, or Firm*—Glenn K. Robbins

[57] ABSTRACT

A packing injector gun for injecting packing under high pressure through a nozzle to pipe flanges and the like. The injector gun has high pressure barrel equipped with a piston to expel packing under high pressure through the nozzle to packing flanges. On the opposite side of the piston a high pressure reservoir communicates with a hand operated hydraulic pump connected to the exterior of the barrel. The hydraulic pump is adapted to force hydraulic fluid at extremely high pressure to the high pressure reservoir gun to operate the piston. The piston shaft to which the piston is connected has a portion extending outside the gun and has a handle for manual operation. A further U-shaped handle is connected to the middle of the barrel and extends over hydraulic pump for carrying by the operator and protection of the hydraulic pump. In a modification the piston is designed to be double acting by a control valve in the hydraulic pump and the packing gun can be loaded with packing at both ends for operation through nozzles at opposite ends of the gun. This modification enables the gun to be loaded with packing compound to obviate shortages and running out of packing in the field.

10 Claims, 4 Drawing Figures

PACKING INJECTOR GUN

SUMMARY OF THE INVENTION

In the past there has been a problem in providing for introduction of packing at extremely high pressures to pipe flanges and other fittings for pipelines where packing is required to be used. In such pipe line flanges, as for example in the oil industry and other industrial areas where flange are encountered using very high pressures, packing may be introduced through fittings to the flanges. Because of the pressure involved and close fit there has been a problem to provide for ready introduction of such packing in the field where maintenance and repair problems are encountered under severe condition sometimes in remote areas such where repairs and maintenance are quite difficult. By means of this invention there has been provided a packing gun for injecting packing through a nozzle under extremely high pressure. The gun is constructed of a rugged steel barrel-like member with a piston. On one side of the piston packing can be loaded and on the other side a hydraulic fluid can be introduced at extremely high pressure. The gun is provided with a special mounting plate on the exterior of the barrel adapted to receive a threaded fitting of a conventional hand operated hydraulic pump. The hydraulic pump is used to pump hydralic fluid under high pressure through the gun to the hydraulic reservoir on the side of the piston opposite the chamber in which the packing is utilized. By means of the hydraulic pump hand operation can be employed to exert an extremely high pressure in the hydraulic reservoir of the gun to inject through the nozzle to the appropriate fitting.

There is provided in the gun piston shaft which extends through an end of the gun barrel and has a handle which can be operated by the operator to withdraw the piston for loading of the packing at the opposite end of the gun. A further U-shaped handle is provided at the middle portion of the gun barrel and extends over the hydraulic pump to serve not only as a handle but also as a protective barrier against damage to the hand operated hydraulic pump.

In a modification the packing gun is provided with nozzles at both ends and appropriate reversing valves in the hydraulic mechanism by means of which hydraulic fluid can be introduced at the opposite sides of a central piston in hydraulic chambers on either side of the piston. Two additional pistons are connected to the central piston by a piston shaft whereby packing can be introduced in packing chambers between nozzles at the opposite ends of the gun and the pistons. In this fashion packing can be expelled through either of the nozzles. When packing in one chamber is near exhaustion additional packing can be introduced in the chamber to insure that the fresh supply is available. The danger of running out of packing in the field is minimized since the operator can determine which chamber needs replenishment before taking to the field.

The packing gun of this invention in both the single nozzle version and the double nozzle modification is extremely rugged in operation and adapted to expel packing at extremely high pressure through the use of the hand operated hydraulic pump. The construction is relatively simple since the gun is made of a standard hydraulic pump and a conventional pipe-like gun barrel using an uncomplicated piston structure that is rugged and economical in cost and operation. It can be used in the field expeditiously where a high degree of performance is made possible where high demand characteristics are required.

The above features are objects of this invention and further objects will appear in the detailed description which follows and will otherwise be apparent to those skilled in the art.

For the purpose of illustration of this invention there is shown in the accompanying drawings a preferred embodiment and modification of this invention. It is to be understood that these drawings are for purpose of illustration only and that the invention is not limited thereto.

IN THE DRAWINGS

DESCRIPTION OF THE INVENTION

Figure 1:
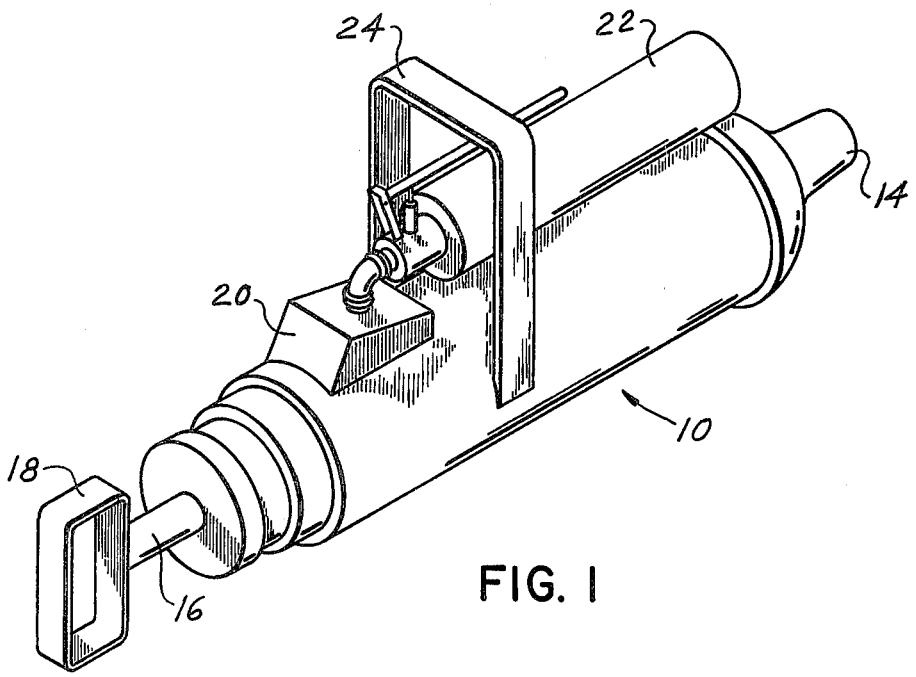
FIG. 1, is a pictorial view of the packing gun.
Figure 2:
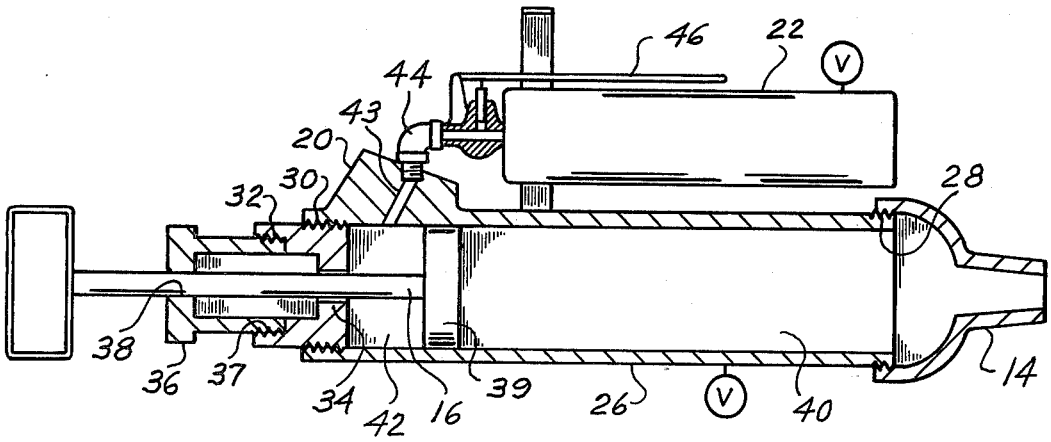
FIG. 2, is a view in side elevation of the gun showing the gun in axial cross section and the hydraulic pump in full body view.

The packing gun of this invention is generally identified by the reference numeral 10 in FIGS. 1 and 2. It is comprised of a gun barrel 12, a packing nozzle 14 at one end and a piston shaft 16 protruding through the opposite end equipped with an O-shaped handle 18. A mounting plate 20 is provided at the top of the gun barrel and is connected to a hand operated hydraulic pump 22. A U-shaped handle 24 is connected to the middle of the barrel and extends over the hydraulic pump.

The barrel 12 more particularly shown in FIG. 2, is comprised of a simple steel pipe construction employing a steel pipe section 26 having a threaded right end 28 to which the threaded nozzle 14 is connected. At the opposite left hand end there is an internal threaded end 30 which receives an externally threaded closure member 32 having an interior threaded portion 34. The member 32 has an internal opening receiving in sliding engagement the piston 16.

The piston shaft support structure further includes a plug member 36 having a threaded end 37 receivable within the closure member 32 and also has a central opening 38 receiving the piston shaft.

A piston 39 connected to the piston shaft defines a packing chamber 40 at the right hand of the piston and a hydraulic pressure reservoir 42 at the left end of the piston. In order to provide for the introduction of hydraulic oil under high pressure to the hydraulic chamber 42 the mounting plate 20 is employed. The mounting plate is welded or otherwise affixed to the top of the gun barrel and has an internal passage 43 which communicates through a threaded fitting 44 to the hydraulic oil pump 22.

The hydraulic oil pump 22 is of conventional construction and utilizes a handle 46 and conventional internal pump structure which form no part of this invention to expel hydraulic oil under high pressure through the fitting and to the hydraulic oil reservoir 42 in the packing gun. Conventional means not shown are provided in the hydraulic pump for releasing the pressure on the hydraulic oil at the conclusion of the pumping operation to permit the withdrawal of the gun handle 18 and move the piston 39 to the left most position to provide for introduction of new packing. A double modification of the packing gun is provided in FIGS. 3 and 4, to provide for discharge of packing under extremely high pressure through opposite ends of the modified gun. In the operation of the modified gun from a central piston can be moved under high pressure toward either end of the gun to expel packing in separate packing chambers.

The double acing gun in the modification is generally identified by the reference numeral 50. It is constructed of a gun barrel 52 having a packing nozzle 54 at the left end and a packing nozzle 56 at the right end. The barrel is connected to the hydraulic pump in the same fashion as in the modification of the gun 12 but employs a reversing valve 58 to direct the hydraulic oil under pressure to either of two separate hydraulic oil reservoirs.

The gun barrel 52 is constructed of a central barrel section 60, a left end section 62 and a right end section 64 which are connected together by threaded sleeve 66 and 68, respectively. Each of the sleeves also connects a partition wall 67 and 69 respectively to the interior of the barrel. Nozzles 54 and 56 are connected to the opposite ends of the gun barrel by threaded engagement in the same fashion as in the gun 12.

The piston structure for the double acting gun 50 employs a central piston 70, a left hand piston 72 and a right hand piston 74. A single piston shaft 76 is employed to connect all the pistons together in fixed relation.

The piston structure defines a left hand packing reservoir 78 and a right hand reservoir 80. A left hand hydraulic oil reservoir 82 is defined between the partition 69 and the piston 70 while a right hand oil reservoir is defined between the central piston 70 and the right hand partition 69. Hydraulic oil lines 86 and 88 connect the left hand oil reservoir and the right hand reservoir with the reversing valve 58.

Figure 3:
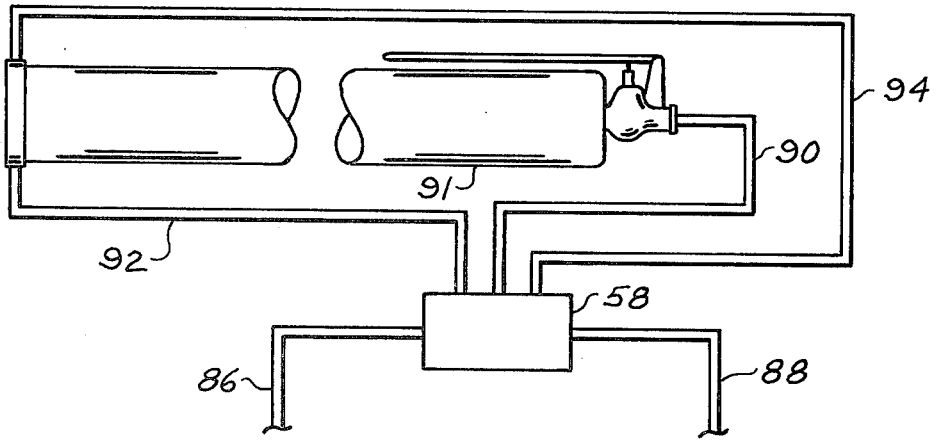
FIGS. 3 and 4, are interrupted views of the modification gun to provide for double packing and hydraulic oil reservoirs and nozzles, the gun being shown in axial cross section and the hydraulic pump in full body view from an opposite side of the view of FIG. 2.
Figure 4:
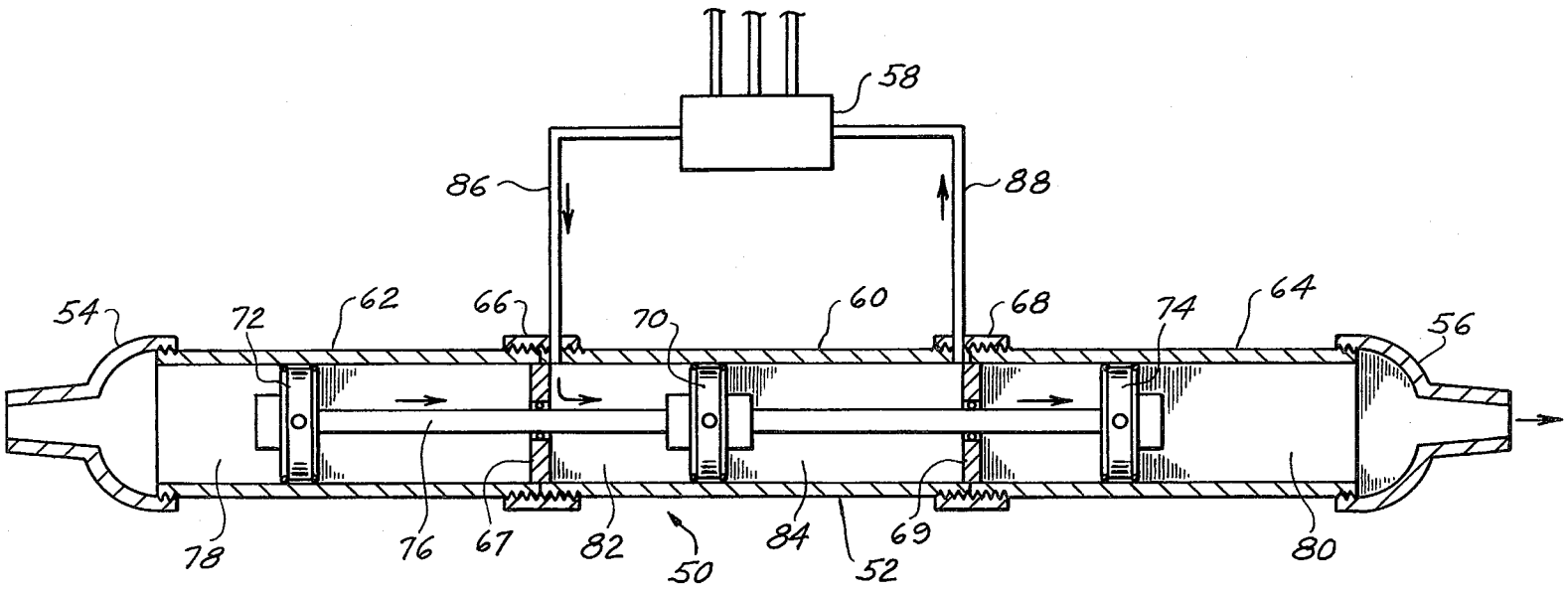

As shown in FIG. 3, the hydraulic pump 91 is provided with an oil power line 90 which leads from the hydraulic pump to the reversing valve 58. Return hydraulic line 92 communicates the left hand hydraulic reservoir with the hydraulic pump while a return line 94 serves the same purpose for the right hand hydraulic reservoir.

The reversing valve 58, and the hydraulic pump 91 adapted for reversing the piston operation are of conventional construction, and form no part of this invention, per se.

USE

The packing gun 10 of this invention is adapted for simple use in the field. For loading the gun nozzle 14 is simply unscrewed and loaded with the necessary packing compound and the nozzle is then again connected to the gun.

In operation the gun is employed to expel packing through the nozzle 14 which may be provided with any appropriate screw or hose fittings for connection to a pipe line flange or the like to which packing is to be introduced. The hydraulic pump is then operated by pumping the handle 46 in the conventional fashion to force hydraulic oil under extremely high pressure to the hydraulic oil reservoir 42. This high pressure causes the gun to expel the packing as the piston 38 moves against the packing. The hydraulic pump handle is employed as necessary to dispense the desired amount of packing.

In use, the handle 18 having the O-shaped configuration can be used for carrying or can be connected to any appropriate hook or the like to hang it as desired. Likewise, the U-shaped handle 24 can be used either for carrying the gun or for suspending it from a hook, rope or cable or the like when not in use. The handles may be employed when in use since the gun may be of appreciable weight and bulk. Thus the gun can be suspended by connection of either of the handles to a support while the operator is free to operate the handle of the hydraulic pump.

The double acting gun 50 is used in a like fashion. It will be understood that the U-shaped handle may also be employed for carrying and also in the operation of the gun in the same fashion as described for the gun 10. In the double acting modification of the gun 50, packing is introduced in both of the packing compound compartments 78 and 80. If the operator desires to expel packing through the nozzle 56 at the right hand portion of the gun. The valve 58 is turned to this direction and hydraulic oil is introduced under pressure by operation of the hydraulic pump to the hydraulic reservoir 82 through line 86. This causes the movement of the piston 70 toward the right to force the piston 74 against the packing in compartment 80 and expel it. As this operation is continued the piston 72 is moved to the right to enlarge the packing compartment 78. As the packing in compartment 80 is deplenished the operator may fill the compartment 78 by screwing the nozzle 54 and adding additional packing compound. In this operation the directional movement is indicated by the arrows in FIG. 4.

At the end of the operation when the packing has been expelled from packing compartment 80 the reversing valve 58 may be reversed to direct hydraulic oil through line 88 to the hydraulic oil compartment 84. Thus when this is accomplished, the packing by operation of the hydraulic pump 91 can be expelled from the left hand compartment 78 through the left hand nozzle 54.

Thus it will be apparent that in the double acting gun 50 packing may be stored in one compartment as a spare reservoir when needed and the operator has means for determining whether the gun is always at least half filled before going into the field.

Various changes and modifications may be made within this invention as will be readily apparent to those skilled in the art. Such changes and modifications are within the scope and teaching of this invention as defined by the claims appended hereto.

What is claimed is:

1. A packing gun for injecting packing at high pressure through a nozzle, said packing gun comprising an elongated cylinder, a movable piston receiving packing on one side and a fluid under pressure on the other side, hydraulic pump means for exerting pressure on said fluid, said means comprising a hydraulic pump mounted on said elongated cylinder and having a high pressure line communicating with said cylinder on said one side receiving fluid under pressure, said hydraulic pump being removably attached to the gun cylinder by a mounting plate, a U-shaped handle, said handle having leg members attached to the side of the gun cylinder and a bight portion positioned above the hydraulic pump, the gun cylinder having packing dispensing nozzles at opposite ends of the gun cylinder and means for alternate loading of packing on opposite sides of the piston and alternate introduction of high pressure fluid on opposite sides of the piston.

2. The packing gun of claim 1, in which a piston shaft is connected to the piston at one end and has a second free end extending through an end of the cylinder opposite said nozzle, said free end being provided with a handle having a bent over portion adapted to be supported upon a hook or the like.

3. A packing gun for injecting packing at high pressure through a nozzle, said packing gun comprising an elongated cylinder, a movable piston receiving packing on one side and a fluid under pressure on the other side, hydraulic pump means for exerting pressure on said fluid, said means comprising a hydraulic pump mounted on said elongated cylinder and having a high pressure line communicating with said cylinder on said one side receiving fluid under pressure, said hydraulic pump being removably attached to the gun cylinder by a mounting plate, said mounting plate being affixed to a side of said cylinder and having a passageway communicating with the interior of said cylinder, said passageway terminating in a threaded opening on the exterior of the mounting plate, and a threaded member engageable with said threaded opening on the mounting plate and having a passageway communicating with an outlet of said hydraulic pump.

4. The packing gun of claim 3, in which said hydraulic pump extends parallel to the axis of said cylinder and has a handle pivoted to said pump likewise extending parallel to the axis of the cylinder.

5. The packing gun of claim 4, in which a U-shaped handle is provided, said handle having leg members attached to the side of the gun cylinder and a bight portion positioned above the hydraulic pump, said handle serving as a barrier to protect said pump from accidental contact.

6. The packing gun of claim 3, in which a U-shaped handle is provided, said handle having leg members attached to the side of the gun cylinder and a bight portion positioned above the hydraulic pump.

7. A packing gun for injecting packing at high pressure through a nozzle, said packing gun comprising an elongated cylinder, a movable piston receiving packing on one side and a fluid under pressure on the other side, hydraulic pump means for exerting pressure on said fluid, said means comprising a hydraulic pump mounted on said elongated cylinder and having a high pressure line communicating with said cylinder on said one side receiving fluid under pressure, the gun cylinder having packing dispensing nozzles at opposite ends of the gun cylinder and means provided for alternate loading of packing on opposite sides of the piston and alternate introduction of high pressure fluid on opposite sides of the piston and a U-shaped handle, said handle having leg members attached to the side of the gun cylinder and a bight portion positioned above the hydraulic pump.

8. The packing gun of claim 7, in which the cylinder is provided with second and third pistons on opposite sides of said first mentioned piston and a piston shaft connecting said pistons, and defining a piston train, partitions in said cylinder between said first piston and said second piston and between said first piston and said third piston defining hydraulic pressure chambers on either side of said first piston and reversing valve means to direct hydraulic fluid selectively to either of said hydraulic pressure chambers to cause the movement of the first piston and the piston train to selectively expel packing through one of the two aforementioned nozzles.

9. The packing gun of claim 8, in which the nozzles are threadedly engageable with the opposite ends of said cylinder and are removable to provide for loading packing in the ends of the cylinder in packing chambers defined by the ends of the cylinder and the second and third pistons.

10. The packing gun of claim 8, in which the cylinder is defined by a first, second and third section butted together, said first and second sections being joined by a first sleeve member supporting one of said partitions and the second and third sections being joined by a second sleeve member supporting a second of said partitions.

* * * * *